US008297011B2

(12) United States Patent
Quick et al.

(10) Patent No.: US 8,297,011 B2
(45) Date of Patent: Oct. 30, 2012

(54) APPARATUS FOR WIND PROTECTION OF BUILDING OPENINGS

(76) Inventors: Leonard Charles Quick, Mandeville, LA (US); Gaetano Dominick Paternostro, Jr., Big Branch, LA (US)

( * ) Notice: Subject to any disclaimer, the term of this patent is extended or adjusted under 35 U.S.C. 154(b) by 0 days.

(21) Appl. No.: 12/728,866

(22) Filed: Mar. 22, 2010

(65) Prior Publication Data

US 2010/0170170 A1 Jul. 8, 2010

Related U.S. Application Data

(63) Continuation-in-part of application No. 11/077,447, filed on Mar. 10, 2005, now abandoned, and a continuation-in-part of application No. 11/973,803, filed on Oct. 10, 2007, now abandoned.

(51) Int. Cl.
*E06B 3/26* (2006.01)

(52) U.S. Cl. ..... 52/202; 52/DIG. 12; 52/127.2; 248/616; 248/354.3; 248/354.5; 410/145

(58) Field of Classification Search ..... 52/202, 52/DIG. 12, 126.3, 118, 67, 127.2; 410/145; 248/616, 125.8, 326, 333, 351, 298.1, 316.8, 248/354.1, 354.3, 354.5, 200.1; 49/54, 55, 49/57

See application file for complete search history.

(56) References Cited

U.S. PATENT DOCUMENTS

| | | | | | |
|---|---|---|---|---|---|
| 2,456,355 | A * | 12/1948 | Aber | 411/360 |
| 2,594,605 | A * | 4/1952 | Zoppelt | 211/123 |
| 2,794,217 | A * | 6/1957 | Croft | 248/200.1 |
| 3,356,329 | A * | 12/1967 | Santo | 248/273 |
| 3,822,850 | A * | 7/1974 | Elias | 248/551 |
| 4,023,819 | A * | 5/1977 | Holman, Jr. | 410/151 |
| 4,343,842 | A * | 8/1982 | Chase | 428/8 |
| 6,030,045 | A * | 2/2000 | Hoshino | 297/461 |
| 6,217,015 | B1 * | 4/2001 | Kulla | 269/296 |
| 6,247,882 | B1 * | 6/2001 | Huang | 410/151 |
| 6,256,939 | B1 * | 7/2001 | Snyder | 52/126.6 |
| 6,330,768 | B1 * | 12/2001 | Rodrigues | 52/202 |
| 6,505,803 | B1 * | 1/2003 | Hernandez | 248/354.5 |
| 6,742,975 | B2 * | 6/2004 | Trine et al. | 410/151 |
| 6,910,312 | B2 * | 6/2005 | Whitworth | 52/741.3 |
| 7,921,612 | B2 * | 4/2011 | Knight et al. | 52/126.6 |

* cited by examiner

*Primary Examiner* — Robert Canfield
*Assistant Examiner* — Brent W Herring
(74) *Attorney, Agent, or Firm* — Kenneth L Tolar

(57) ABSTRACT

An apparatus for securing a protective panel over a window includes at least one telescoping retainer bar that is tightly fixed within a window frame, adjacent the panel. Spring-biased locking buttons removably seat within one or more longitudinally-disposed apertures to fix the retainer bar at a desired length. At each end of the bar is a resilient pad that firmly engages one of two opposing sides of a window or door frame. One of the pads is movable relative to the bar to further tighten the bar within the frame once the telescoping bar has been extended as far as possible. The pad at the opposing end includes a biasing means for further anchoring the bar within the frame.

8 Claims, 4 Drawing Sheets

APPARATUS FOR WIND PROTECTION OF BUILDING OPENINGS

CROSS-REFERENCE TO RELATED APPLICATIONS

This application is a continuation-in-part of application Ser. No. 11/077,447 filed on Mar. 10, 2005 now abandoned, and application Ser. No. 11/973,803 filed on Oct. 10, 2007 now abandoned, both entitled "Apparatus for Wind Protection of Building Openings," the full disclosures of which are incorporated by reference herein and priority of which are hereby claimed.

BACKGROUND OF THE INVENTION

The present invention relates to the prevention of wind damage to windows and doors that can occur during hurricanes and other major storms. More particularly, the present invention relates to a device for securing protective panels within window and door frames to protect glass from projectiles and wind damage during hurricanes, tornadoes and other major storms.

Many buildings in certain areas of the country are damaged by violent storms when wind-blown objects impact windows and glass doors. To prepare for a major storm, building occupants often install protective panels over windows and other glass surfaces to prevent breakage. Typically, the occupant must drive piercing fasteners, such as screws or nails, through both the panel and the window frame. However, installing the fasteners is laborious and time-consuming; the fasteners also create unsightly holes through which moisture intrudes thereby damaging both the building interior and the frame. Additionally, many window manufacturers will dishonor a warranty if a fastener hole is formed in the frame.

The present invention overcomes the above-described disadvantages associated with conventional methods of installing protective coverings over a window by providing a panel retainer that is securable within a window opening without the need for penetrating fasteners.

SUMMARY OF THE INVENTION

It is therefore an object of the present invention to provide an apparatus for retaining a protective panel within a door or window frame.

It is another object of the present invention to provide an apparatus for retaining a protective panel within a window or door frame that requires minimal labor or equipment.

It is yet another object of the present invention to provide an apparatus for retaining a protective panel within a window or door frame that includes resilient end pads to prevent slipping.

These and other objects of the present invention are achieved by providing an apparatus including at least one telescoping retainer bar that is tightly fixed within a window frame, adjacent a protective panel. Spring-biased locking buttons removably seat within one or more longitudinally-disposed apertures to fix the retainer bar at a desired length.

At each end of the bar is a resilient pad that firmly engages one of two opposing sides of a window or door frame. One of the pads is movable relative to the bar to further tighten the bar within the frame once the telescoping bar has been extended as far as possible. The pad at the opposing end includes a biasing means for further anchoring the bar within the frame.

DETAILED DESCRIPTION OF THE PREFERRED EMBODIMENT

Figure 1:
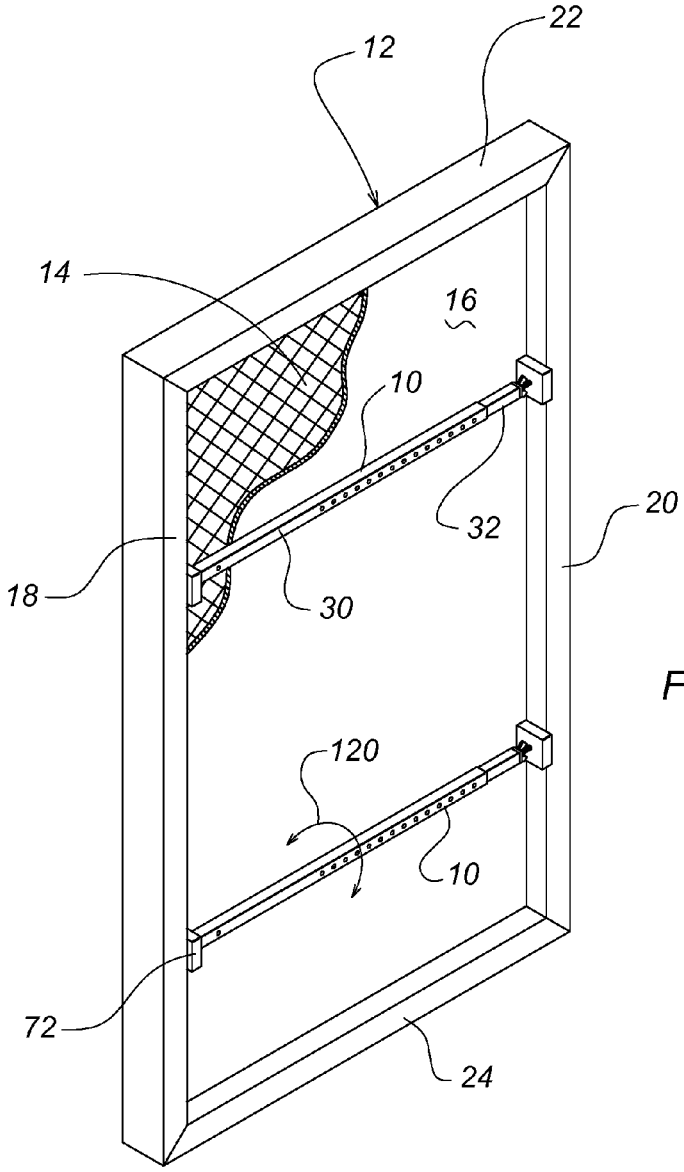
FIG. 1 depicts the retainer according to the present invention installed within a window frame.
Figure 2:
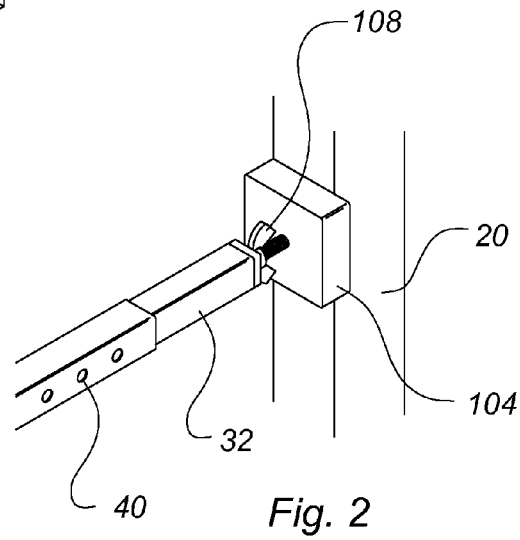
FIG. 2 is a detailed view of the second mounting assembly.
Figure 3:
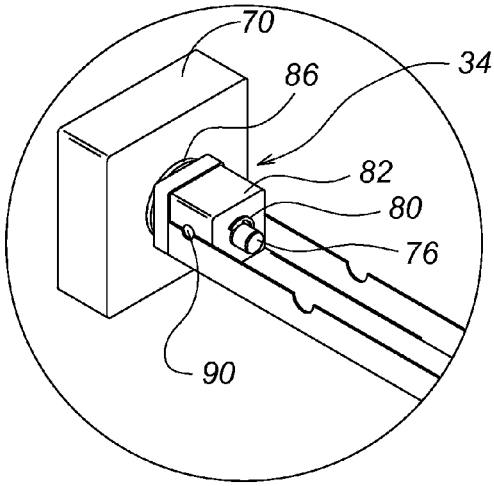
FIG. 3 is detailed view of the first mounting assembly.

Referring now specifically to the drawings, reference numeral 10 designates a retaining bar in accordance with the present invention. As can be seen in FIG. 1, one or more retaining bars 10 may be provided for each building opening, depending on the height of the opening and the size of the protective panel. A window or door frame 12 surrounds a fragile panel 14, such as a glass window. In preparation for a storm, a user constructs a protective panel 16 using plywood, metal, plastic or any other similar, shatterproof material. The panel 16 is sized to tightly fit within the frame opening 12 as defined by vertical frame members 18, 20 and horizontal frame members 22, 24. The retaining bars 10 may be positioned between the vertical panel members 18 and 20, or between horizon al frame members 22, 24, as desired.

The retaining bar 10 is formed of a first, elongated, tubular bar member 30 and a second, elongated, bar member 32 telescopically received therein. A first mounting assembly 34 is secured on a free end of the first bar member 30 while a second mounting assembly 36 is secured on the free end of the second bar member 32. A plurality of openings 40 are longitudinally disposed on an outside wall 42 of the first bar member 30 that are aligned with corresponding openings formed on an inside wall 46. A locking means is releasably inserted through the aligned openings to fix the bar at a select length.

Figure 4:
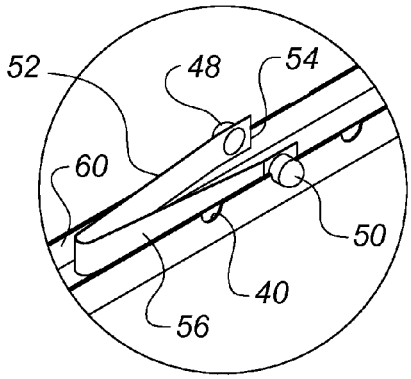
FIG. 4 is detailed, partially-cutaway view of the spring-biased button mechanism for fixing the bar at a desired length.
Figure 5:
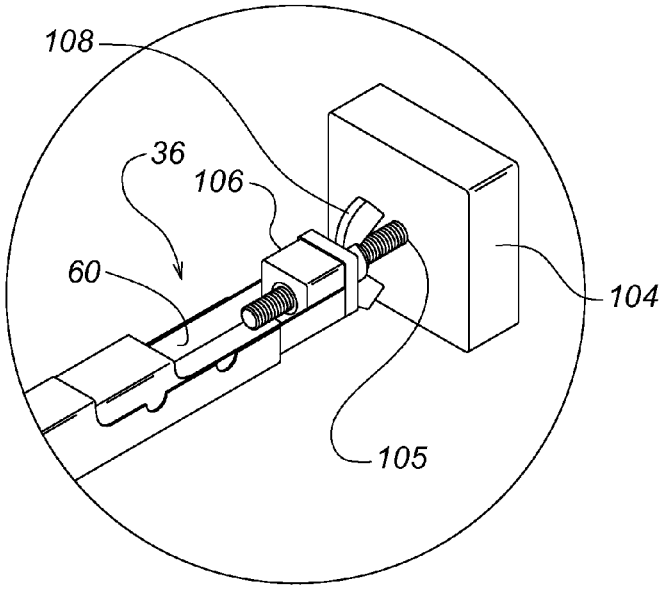
FIG. 5 is a detailed, partially-cutaway view of the second mounting assembly.
Figure 7:
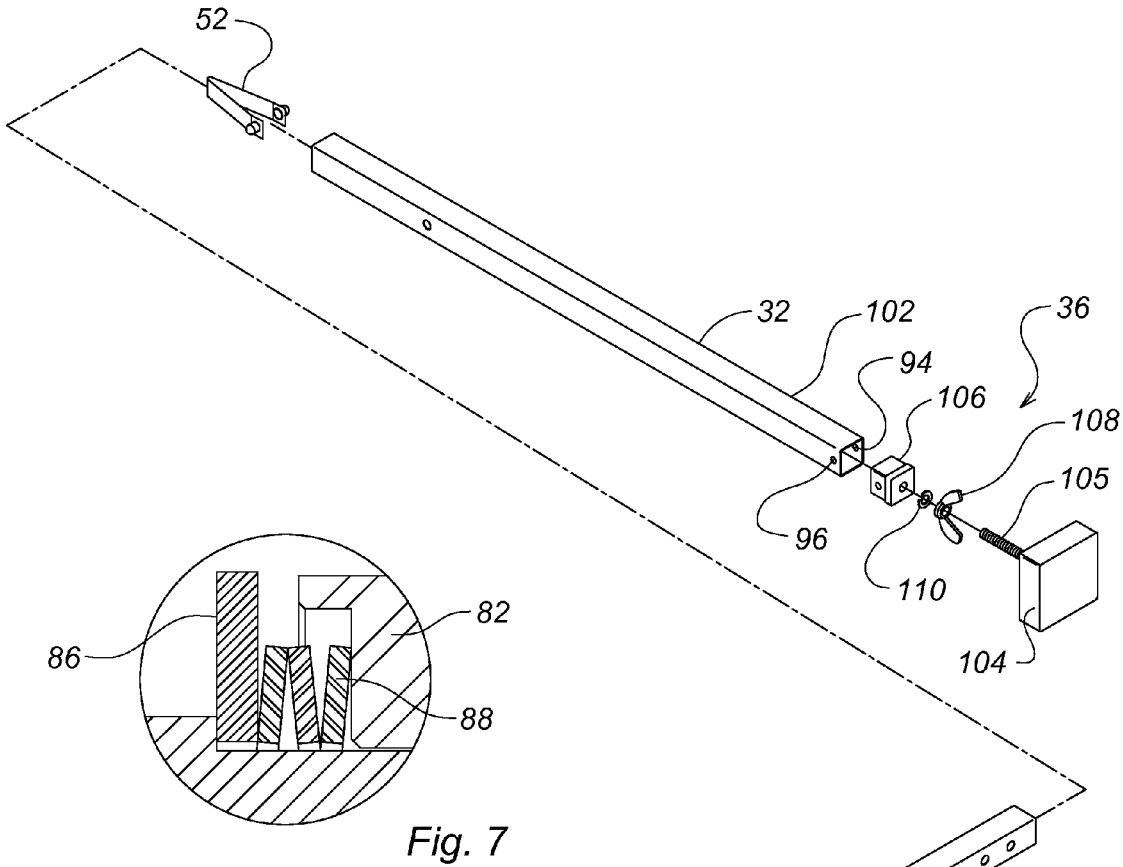
FIG. 7 is a detailed view of the washer assembly of the first mounting assembly.
Figure 6:
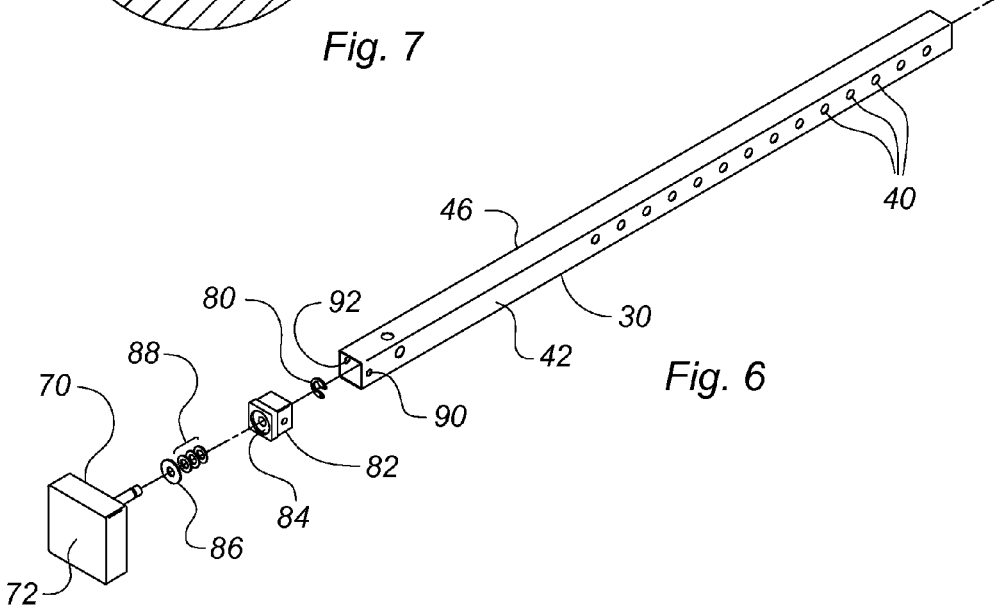
FIG. 6 is an exploded view of the retainer.
Figure 8:
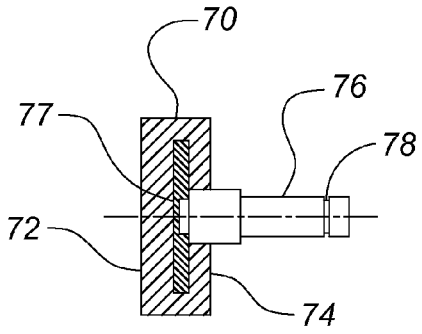
FIG. 8 is an isolated view of the first pad.

The locking means of the present invention comprises one or more snap buttons 48 and 50, which extend through the openings 40 and the opposing openings, when released. The snap buttons 48 and 50 are secured on a V-shaped tension member 52 having the snap buttons 48 and 50 on respective legs 54 and 56. The tension member 52 normally urges the locking buttons 48, 50 into the openings in the inside wall 46 and the outside wall 42. When depressed, the snap buttons 48 and 50 recede into a channel 60 defined by the second bar member 32 (FIG. 4), allowing telescopic, slidable movement of the second bar member 32 in relation to the first bar member 30. When released, the snap buttons 48 and 50 are forced into the aligned openings in the walls 42, 46, thereby fixing the length of the retainer bar 10 at a select length within the frame opening 12.

The first mounting assembly 34 comprises a first contact pad 70 having an inner surface 74, and an outer surface 72 for contacting the frame member 22. The contact pad is formed from a resilient but sightly compressible material to firmly engage the frame 12. Extending from the contact pad 70 is a shaft 76 having a transverse plate 77 on an inner end thereof that prevents the plate 77 and pad 70 from disengaging. At a distal end of the shaft 76 is a peripheral groove 78 for receiving a split snap ring 80 therein.

The first mounting assembly further comprises a first end cap 82 that includes a central opening 83 surrounded by a larger-diameter counter bore 84. A flat, ring-shaped washer 86 is mounted on the shaft 76 and contacts the first pad 70. A plurality of stacked, Belleville washers 88 are mounted on the shaft 76 between the flat washer 86 and the first end cap 82 to provide a biasing means between the end cap 82 and the pad 70. The stacked Belleville washers bias the first pad outwardly when the bar member 10 is rotated to tighten the device within the frame 12. The number of Belleville washers may be varied to modify the biasing force; stacking washers in the same direction will provide a stronger biasing force with minimal movement of the pad while stacking in alternating directions will provide a weaker biasing force but greater movement of the pad 70. Stacking any combinations of oppositely-directed and similarly-facing washers will allow a manufacturer to create a desired biasing force and displacement range.

A securing pin (not shown) can be inserted through openings 90, 92 formed in the first retaining bar member 30 and/or through aligned openings 94, 96 of the second retaining bar member 32. The first end cap is sized and configured to at least partially fit within the channel defined by the first retaining bar member 30.

Figure 9:
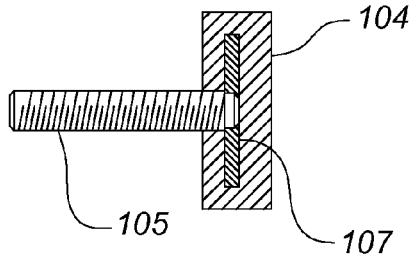
FIG. 9 is an isolated view of the second pad.
Figure 10:
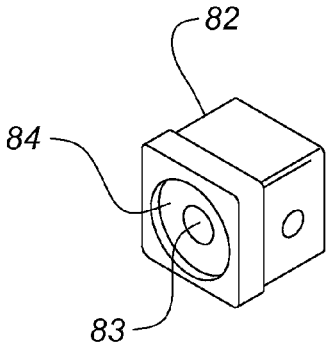
FIG. 10 is an isolated view of the first end cap.
Figure 11:
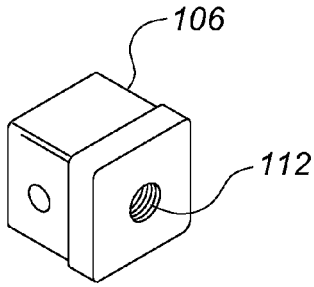
FIG. 11 is an isolated view of the second end cap.

A second mounting assembly 36 is mounted on a free end 102 of the second bar member 32. The second mounting assembly 36 comprises a second contact pad 104 having a threaded bolt 105 extending from an inner surface thereof. The bolt is threadedly received within a threaded opening formed on a second end cap 106 fastened to the free end 102 of the bar member 32. The end cap 106 is sized and configured to at least partially fit within the channel 60 defined by the second bar member 32. A tightening member 108, such as a wing nut or similar device, is adjustably mounted on the bolt 105 for tightening against a lock washer 110 to fix the second pad 104 at a select distance from the second end cap 106. As can be seen in FIG. 9, the threaded bolt 105 includes a transverse plate 107 on a proximal end that is embedded within the pad 104 to prevent disengagement.

The contact pads 70 and 104 can be made from a hardened material, such as neoprene, or any other similar material that provides a certain degree of resilience while not damaging the frame 13. However, as will be readily apparent to those skilled in the art, the size, shape and materials of construction of the various components may be varied without departing from the spirit of the present invention.

To install the device, a user places the protective panel 16 over the glass sheet 14 and positions at least one retainer bar 10 between the vertical frame members 18 and 20 (or the horizon al members 22,24). The first mounting assembly 34 is placed against the inner surface of frame member 18 and the snap buttons 48 and 50 are depressed to allow the bar 10 to be extended. The second bar member is extended outwardly relative to the first bar member until the second pad 104 engages, or nearly engages vertical frame member 20. The snap buttons 48, 50 are then released and seated within a nearest one of the openings 40 to fix the bar 10 at a substantially-extended orientation. The second pad 104 is rotated until it firmly engages the frame member 20 thereby tenuously fixing the bar 10 between frame members 18,20. Because the pads 72, 104 engage respective frame members 18,20, the bar 10 is rotatable while the pads 72, 104 remain fixed. The entire bar 10 is then rotated in a direction that causes the bolt 105 to extend the pad 104 relative to the second bar member 32 until the bar is firmly anchored between the frame members 18,20. A tightening rod 102 may be inserted into openings 90,92 to provide additional leverage to further tighten the bar 10. A washer 110 prevents overtightening of the bar. The wing nut 108 is then tightened against the second end cap to further secure the components in a fixed orientation. To remove the device, the above-described process is reversed.

Preferably, the length of the bar members 30, 32 are such that the entire device is adjustable to fit within a 3-foot to a 4½-foot window frame; however, the length can be varied to accommodate larger or smaller window frames as well.

The retainer bar 10 can be ins ailed in a relatively short period of time following notification from the National Weather Service that a hurricane, tornado or other windstorm is approaching. The protective panel 16 can be precut to fit into a desired opening and one or two retaining bars 10 are secured over the panel 16 without the need for penetrating fasteners. Once the storm subsides, the retainer bars 10 can be removed by simply retracting the bar members 30, 32 and storing the protective panel 16 and bar 10 for future use.

The above-described device is not limited to the exact details of construction and enumeration of parts provided herein. The retaining bar 10 can be made from a lightweight, corrosive-resistant material such as aluminum. However, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The invention claimed is:

1. An apparatus for retaining protective panels between a pair of window frame members comprising:

a retainer bar having a first end and a second end, said retainer bar formed of a first bar member with a second bar member telescopically received therein;

a first pad at the first end of said bar;

a second pad at the second end of said bar;

means for extending said second pad relative to said bar when said first pad and said second pad are placed against a support surface and said bar is rotated;

means for locking said second pad at a select extension relative to said bar;

means for biasing said first pad away from said first end of said bar to exert a tight force against one of said window frame members when said second pad is extended to engage another of said window frame members to securely anchor said bar, wherein said means for biasing said first pad includes a first end cap mounted on the first end of said bar, said end cap including a cavity and a central passageway with a plurality of Belleville washers received within said cavity and positioned between said end cap and said first pad.

2. The apparatus according to claim 1 wherein said means for extending said second pad comprises:

a second end cap at the second end of said bar, said end cap having a threaded opening;

a threaded shaft extending from said second pad and received within said threaded opening whereby rotation of said second pad relative to said bar moves said second pad relative to said bar.

3. The apparatus according to claim 2 wherein said means for locking said second pad at a select extension relative to said bar comprises a threaded fastener mounted on said threaded shaft, said fastener axially translatable along said threaded shaft to tightly engage said second end cap to further fix said bar at a desired length.

4. The apparatus according to claim 1 further comprising:

a hole proximal either of said first end and said second end of said bar;

a leveraging tool removably received within said hole for further extending said second pad.

5. The apparatus according to claim 1 further comprising:

said first pad including a shaft extending therefrom and received within said passageway, said shaft having a circumferential groove proximal a distal end thereof;

a retainer positioned within said groove to retain said end cap on said shaft.

6. The apparatus according to claim 5 wherein said retainer is a split ring.

7. The apparatus according to claim 1 further comprising means for fixing said second bar member at a desired extension relative to said first bar member.

8. The apparatus according to claim 7 wherein said means for fixing said second bar member at a desired extension relative to said first bar member comprises:

a plurality of apertures on said first bar member;

at least one depressible, spring-biased button within said second bar member that releasably seats within any one of said apertures.

* * * * *